United States Patent [19]

Hiraga et al.

[11] Patent Number: 4,824,346

[45] Date of Patent: Apr. 25, 1989

[54] SCROLL TYPE FLUID DISPLACEMENT APPARATUS WITH BALANCED DRIVE MEANS

[75] Inventors: Masaharu Hiraga, Honjyo; Kiyoshi Terauchi, Isesaki; Kiyosh Miyazawa, Annaka; Seiichi Sakamoto, Gunma, all of Japan

[73] Assignee: Sanden Corporation, Gunma, Japan

[21] Appl. No.: 244,961

[22] Filed: Mar. 18, 1981

[51] Int. Cl.[4] ..... F01C 1/04; F01C 19/00

[52] U.S. Cl. ..... 418/55; 418/57; 418/151

[58] Field of Search ..... 418/55, 57, 151

[56] References Cited

U.S. PATENT DOCUMENTS

| | | | |
|---|---|---|---|
| 801,182 | 10/1905 | Creux | 418/55 |
| 1,906,142 | 4/1933 | Ekelof | 418/57 |
| 3,874,827 | 4/1975 | Young | 418/151 |
| 3,884,599 | 5/1975 | Young et al. | 418/55 |
| 3,924,977 | 12/1975 | McCullough | 418/55 |
| 3,986,799 | 10/1976 | McCullough | 418/55 |
| 3,994,633 | 11/1976 | Shaffer | 418/55 |
| 3,994,635 | 11/1976 | McCullough | 418/55 |
| 3,994,636 | 11/1976 | McCullough et al. | 418/55 |
| 4,065,279 | 12/1977 | McCullough | 418/55 |

*Primary Examiner*—John J. Vrablik

*Attorney, Agent, or Firm*—Banner, Birch, McKie & Beckett

[57] ABSTRACT

A scroll-type fluid displacement apparatus, in particular, a compressor unit is disclosed. The unit includes a housing with a fluid inlet port and a fluid outlet port. A fixed scroll with first end plate and first spiral element is fixedly disposed in the housing. An orbiting scroll with a second end plate and a second spiral element is disposed for orbiting motion in the housing. The first and second spiral elements interfit with one another at an angular offset to make a plurality of line contacts to define at least one pair of sealed off fluid pockets. A drive pin extends from an inner end of a drive shaft. The orbiting scroll has a boss which rotatably supports a bushing. An eccentric hole is formed in the bushing and the drive pin is received within this hole. The center of the drive pin is located on an opposite side to the center of the drive shaft with regard to a straight line, which passes through the center of the bushing and is perpendicular to a connecting line passing through the center of the drive shaft and the center of the bushing. The center of the drive pin also is beyond the connecting line in the direction of rotation of the drive shaft. The bushing has a balance weight for cancelling a centrifugal force which arises because of the orbiting motion of the scroll member and bushing. Dynamic balance is accomplished by the use of a pair of balance weights affixed to the drive shaft for generating a moment of the same amount, but opposite in direction, to the moment generated by a force due to the interaction of the centrifugal force of the orbiting parts and the first balance weight.

27 Claims, 6 Drawing Sheets

SCROLL TYPE FLUID DISPLACEMENT APPARATUS WITH BALANCED DRIVE MEANS

BACKGROUND OF THE INVENTION

This invention relates to fluid displacement apparatus, and in particular, to fluid compressor units of the scroll type.

Scroll-type apparatus have been well known in the prior art. for example, U.S. Pat. No. 801,182 discloses a device including two scroll members each having an end plate and a spiroidal or involute spiral element. The scroll members are maintained angularly offset so that both spiral elements interfit at a plurality of line contacts between their spiral curved surfaces to thereby seal off and define at least one pair of fluid pockets. The relative orbital motion of these scroll members shifts the line contact along the spiral curved surfaces, and, therefore, changes the volume of the fluid pockets. The volume of the fluid pockets increases or decreases dependent on the direction of orbital motion. Therefore, the scroll-type apparatus is applicable to compress, expand or pump fluids. In comparison with conventional compressors of the piston-type, a scroll-type compressor has certain advantages such as fewer number of parts, and continuous compression of fluid. However, there have been several problems, primarlily sealing of the fluid pockets, wearing of the spiral elements, and outlet and inlet porting.

Although various improvements in the scroll-type compressor have been disclosed in many patents, for example, U.S. Pat. Nos. 3,884,599, 3,924,977, 3,994,633, 3,994,635 and 3,994,636, such improvements have not sufficiently resolved these and other problems.

In particular, it is desired that sealing force at the line contact be sufficiently maintained in a scroll-type compressor, because the fluid pockets are defined by the line contacts between two spiral elements which are interfitted together, and the line contacts shift along the surface of the spiral elements toward the center of spiral elements by the orbital motion of scroll member, to thereby move the fluid pockets to the center of the spiral elements with consequent reduction of volume, and compression of the fluid in the pockets. On the other hand, if the contact force between the spiral elements becomes too large in maintaining the sealing line contact, wear of spiral elements surfaces increases. In view of this, contact force of both spiral elements must be suitably maintained. However, these contact forces can not be precisely maintained because of dimensional errors in manufacturing of the spiral elements, and because to decrease the dimensional errors of spiral elements during manufacture, would complicate the manufacture of spiral elements.

Furthermore, at least one of spiral elements undertakes orbital motion to accomplish the fluid compression. Therefore, the compressor can vibrate by virtue of centrifugal force caused by this orbital motion.

These problems, that is, sealing of the fluid pockets or vibration, are not completely resolved by the abovementioned patents.

SUMMARY OF THE INVENTION

It is an object of this invention to provide an improvement in a fluid displacement apparatus, in particular a compressor unit of the scroll-type which has excellent sealing of the fluid pockets and anti-wearing of spiral elements surfaces.

It is another object of this invention to provide a fluid displacement apparatus, in particular a compressor unit of the scroll-type which holds a dynamic balance and, therefore, prevents vibration of the compressor.

It is still another object of this invention to provide a fluid displacement apparatus, in particular a compressor unit of the scroll-type which is simple in construction and production and which achieves the above described objects.

A scroll-type fluid displacement apparatus according to this invention includes a housing having a fluid inlet port and fluid outlet port. A fixed scroll member is fixedly disposed within the housing and has a first end plate from which a first wrap extends. An orbiting scroll has a second end plate from which a second wrap extends. The first and second wraps interfit at an angular offset of 180° to make a plurality of line contacts to define at least one sealed off fluid pocket. A drive pin extends from an eccentric location at the inner end of the drive shaft and is connected to the orbiting scroll for transmitting orbital movement through a bushing. A rotation preventing mechanism is disposed in the housing for preventing the rotation of the orbiting scroll during the orbital motion so that, the fluid pockets change volume due to the orbital motion of the orbiting scroll. The second end plate of the orbiting scroll has a boss on a side opposite to the side from which the second wrap extends. A bushing is rotatably supported in the boss. An eccentric hole is formed in an end surface of the bushing at a location eccentric of the center of the bushing. The drive pin is inserted into the eccentric hole, therefore, the bushing is rotatably supported by the drive pin. A center of drive pin located in an opposite side to a center of the drive shaft with regard to a straight line which passes through the center of the bushing and perpendicular to a connecting line passing through the center of the shaft and the center of the bushing, and beyond the straight line passing through the center of the shaft and the center of the bushing in the direction of rotation of the drive shaft. The bushing has a balance weight to cancel a centrifugal force which arises because of the orbital motion of the orbiting scroll member and the parts of the apparatus which orbit with it.

The drive shaft and bushing are connected by the drive pin for transmitting the orbital motion. The drive shaft can be provided with another pin connected to the bushing to restrict the range of swing of the bushing around the drive pin.

The drive shaft can also be provided with two additional balance weights to cancel the moment caused by the centrifugal force of the orbiting scroll member and the first balance weight.

DETAILED DESCRIPTION OF THE PREFERRED EMBODIMENTS

Figure 1:
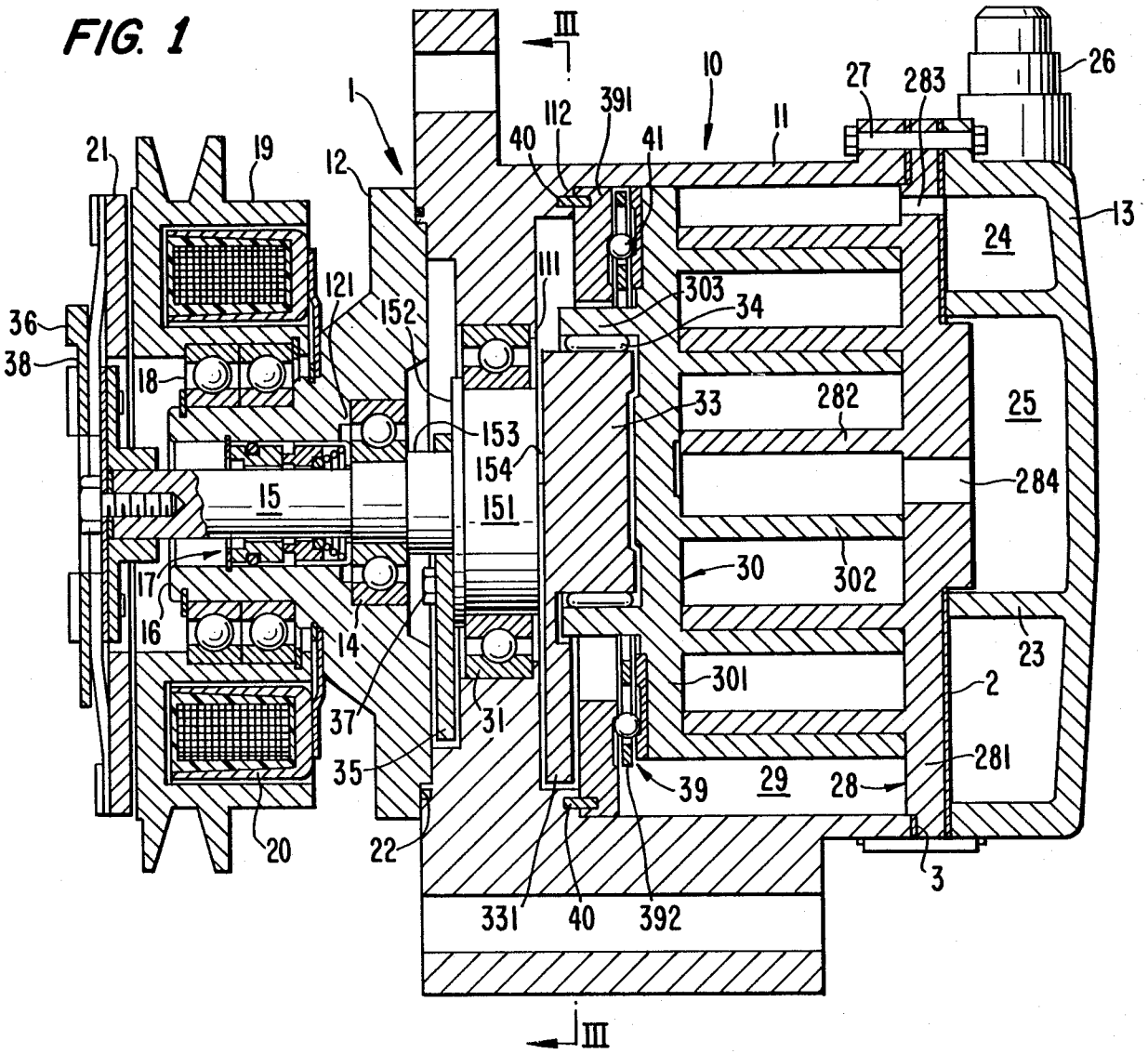
FIG. 1 shows a vertical sectional view of a compressor unit of the scroll-type according to an embodiment of this invention.

Referring to FIG. 1, an embodiment of a fluid displacement apparatus in accordance with the present invention, in particular a refrigerant compressor unit 1 is shown. The compressor unit 1 includes a compressor housing 10 having a cylindrical housing 11, a front end plate 12 attached to a front end portion of the cylindrical housing 11 and a rear end plate 13 attached to a rear end portion of the cylindrical housing 11. An opening is formed in front end plate 12 and a drive shaft 15 is rotatably supported by a ball bearing 14 in the opening. Front end plate 12 has a sleeve 16 projecting from the front surface thereof and surrounding drive shaft 15 to define a shaft seal cavity. A shaft seal assembly 17 is coupled to drive shaft 15 within the shaft seal cavity. A pulley 19 is rotatably supported by a bearing assembly 18 which is carried on the outer surface of sleeve 16. An electromagnetic annular coil 20 is fixed to the outer surface of sleeve 16 and is received in an annular cavity of the pulley 19. An armature plate 21 is elastically supported on the outer end of the drive shaft 15 which extends from sleeve 16. A magnetic clutch thus includes pulley 19, magnetic coil 20 and armature plate 21. In operation, drive shaft 15 is driven by an external drive power source, for example, a motor of a vehicle, through a rotational force transmitting means such as the above described magnetic clutch.

Front end plate 12 is fixed to front end portion of cylindrical housing 11 by bolts (not shown) to thereby cover an opening of cylindrical housing 11 and is sealed by an O-ring 22. Rear end plate 13 has an annular projection 23 on its inner surface to partition a suction chamber 24 from a discharge chamber 25. Rear end plate 13 has a fluid inlet port 26 and fluid outlet port (not shown), which respectively are connected to the suction and discharge chambers 24, 25. Rear end plate 13, together with a circular end plate 281 are attached to the rear end portion of cylindrical housing 11 by a bolt-nut 27. The circular end plate 281 is located in a hollow space between cylindrical housing 11 and rear end plate 13 and is secured to cylindrical housing 11. Gaskets 2 and 3 prevent fluid leakage past the outer perimeter of the end plate 281 and between suction chamber 24 and discharge chamber 25.

A fixed scroll 28, having an involute center 0, includes the circular end plate 281 and a wrap or spiral element 282 affixed to or extending from one side surface of circular plate 281. Circular plate 281 is fixedly secured between the rear end portion of cylindrical housing 11 and rear end plate 13. The opening of the rear end portion of cylindrical housing 11 is thereby covered by the circular plate 281. Spiral element 282 extends into an inner chamber 29 of cylindrical housing 11.

An orbiting scroll 30, having an involute center 0′, is also placed in the chamber 29. Orbiting scroll 30 also includes a circular end plate 301 and a wrap or spiral element 302 affixed to or extending from one side surface of circular plate 301. The spiral element 302 and spiral element 282 of fixed scroll 29 interfit at an angular offset of 180° and at a predetermined radial offset. Orbiting scroll 30, which is connected to a drive mechanism and to a rotation preventing/thrust bearing mechanism, is driven in an orbital motion at a circular radius Ro by rotation of drive shaft 15 to thereby compress fluid passing through the compressor unit.

Generally, radius Ro of orbital motion is given by $$\frac{\text{(pitch of spiral element)} - 2\text{(wall thickness of spiral element)}}{2}$$

Figure 8:
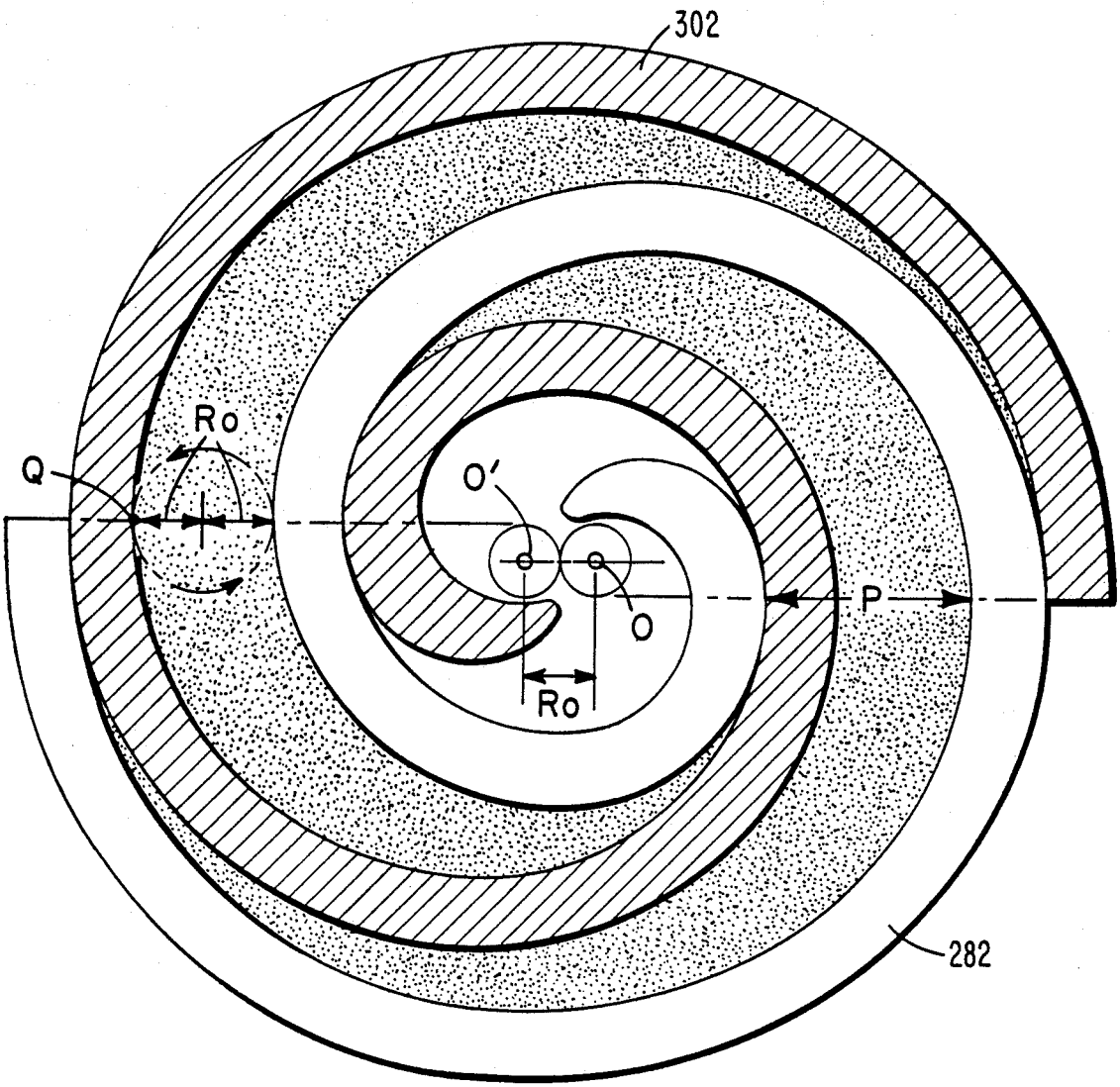
FIG. 8 is a diagrammatic sectional view illustrating the spiral elements of the fixed and orbiting scroll.

As seen in FIG. 8, the pitch (P) of the spiral elements can be defined by $2\pi r_g$, where $r_g$ is the involute circle radius. The radius of orbital motion Ro is also illustrated in FIG. 8 as a locus of an arbitrary point Q on orbiting scroll 30. Center of spiral element 302 is placed radially offset from an involute center of spiral element 282 of fixed scroll 28 by the distance Ro. Thereby, orbiting scroll 30 is driven in orbital motion of a radius Ro by the rotation of drive shaft 15. As the scroll 30 orbits, line contacts between both spiral elements 282, and 302 shift to the center of spiral elements along the surface of the spiral elements. Fluid pockets defined between the spiral elements 282 and 302 move to the center with a consequent reduction of volume, to thereby compress the fluid in the pockets. Circular plate 281 of fixed scroll 28 has a hole or suction port 283 which communicates between suction chamber 24 and inner chamber 29 of cylindrical housing 11. A hole or discharge port 284 is formed through the circular plate 281 at a position near the center of spiral element 282 to connect discharge chamber 25 with the fluid pockets. Therefore, fluid, or refrigerant gas, which is introduced into chamber 29 from an external fluid circuit through inlet port 26, suction chamber 24 and hole 283 is taken into fluid pockets formed between both spiral elements 282 and 302. As scroll 30 orbits, fluid in the fluid pockets is compressed and the compressed fluid is discharged into discharge chamber 25 from the fluid pocket at the spiral elements center through hole 284, and therefrom, discharged through an outlet port (not shown) to an external fluid circuit, for example, a cooling circuit.

Figure 2:
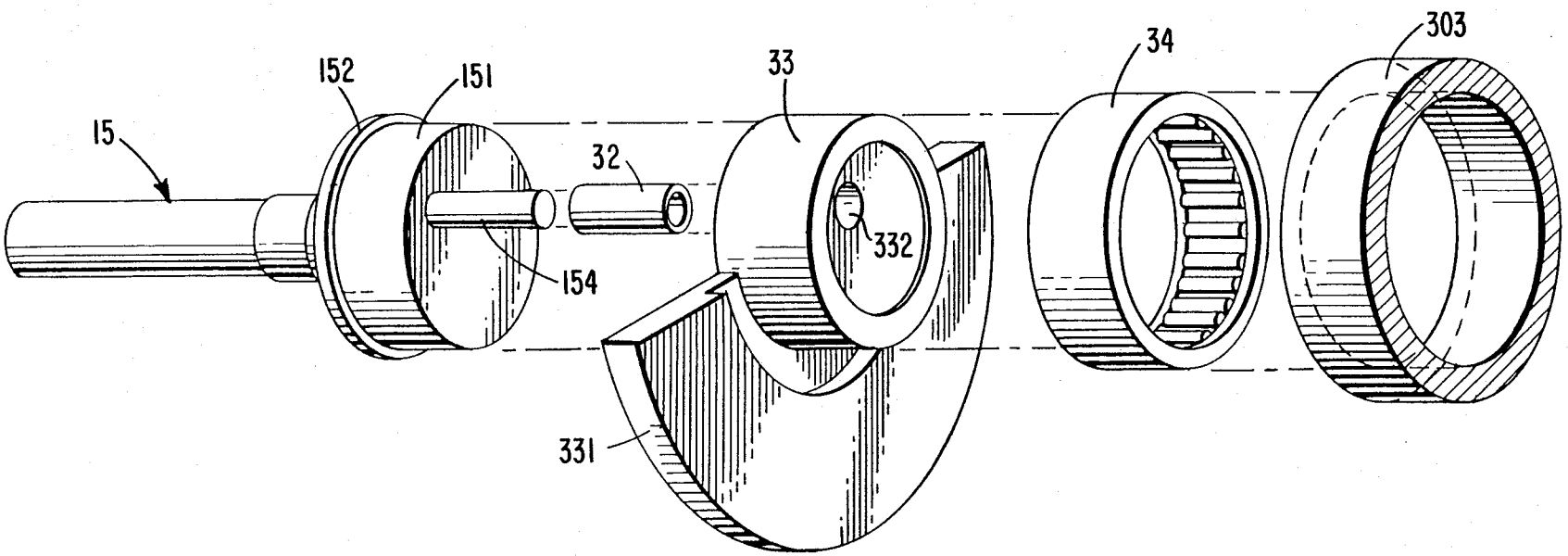
FIG. 2 is an exploded perspective view of the driving mechanism in the embodiment of FIG. 1.
Figure 3:
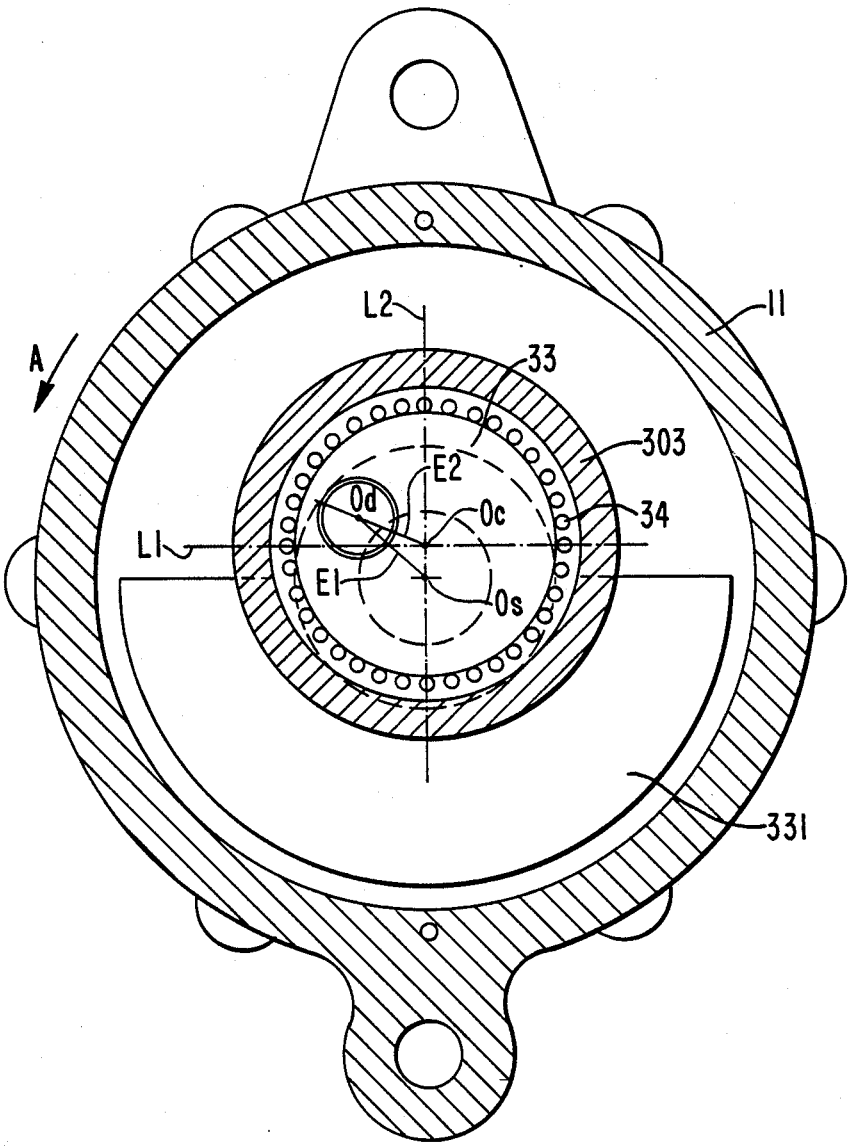
FIG. 3 is a sectional view taken along a line 3—3 in FIG. 1.

Referring to FIGS. 1, 2 and 3 a driving mechanism of orbiting scroll 30 will be described in greater detail. Drive shaft 15, which is rotatably supported by front end plate 12 through ball bearing 14 is connected to disk 151 at one of its ends. Disk 151 is rotatably supported by ball bearing 31 which is carried in a front end opening of cylindrical housing 11. The inner ring of the ball bearing 31 is fitted against a collar 152 of disk 151, and the outer ring of bearing 31 is fitted against a collar 111 formed at front end opening of cylindrical housing 11. An inner ring of ball bearing 14 is fitted against a stepped portion 153 of driving shaft 15 and an outer ring of ball bearing 14 is fitted against a shoulder portion 121 of the opening of front end plate 12. In this manner, driving shaft 15, ball bearing 14 and ball bearing 31 are supported for rotation without axial motion.

A crank pin or drive pin 154 projects axially from an end surface of disk 151 and, hence, from an end of drive shaft 15, at a position which is radially offset from the center of drive shaft 15.

Figure 4:
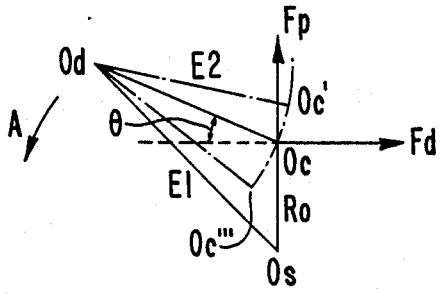
FIG. 4 is a diagram of the motion of the bushing in the embodiment of FIG. 1.

Circular plate 301 of orbiting scroll 30 has a tubular boss 303 axially projecting from the end surface. opposite the surface from which spiral element 302 extends. A discoid or short axial bushing 33 fits into boss 303, and is rotatably supported therein by a bearing, such as a needle bearing 34. Bushing 33 has a balance weight 331 which is shaped as a portion of a disc or ring and extends radially from the bushing 33 along a front surface thereof. An eccentric hole 332 is formed in the busing 33 at a position radially offset from center of the bushing 33. Drive pin 154 fits into the eccentrically disposed hole 322 together with a bearing 32. Bushing 33 is therefore driven in an orbital path by the revolution of drive pin 154 and can rotate within needle bearing 34. Respective placement of center Os of shaft 15, center Oc of bushing 33, and center Od of hole 332 and thus of drive pin 154, is shown in FIG. 3. In the position shown in FIG. 3, the distance between Os and Oc is the radius Ro of orbital motion, which is shown there for purposes of explanation. When drive pin 154 is fitted in to eccentric hole 332, center Od of drive pin 154 is placed, with respect to Os, on the opposite side of a line L1, which is through Oc and perpendicular to a line L2 through Oc and Os, and also beyond the line through Oc and Os in direction of rotation A of shaft 15. This relationship centers Os, Oc and Od holds true in all rotative positions of drive shaft 15. As seen in FIGS. 3 and 4, Od, at this particular point of motion, is located in the upper left hand quadrant defined by the lines L1 and L2.

In this construction of a driving mechanism, center Oc of bushing 33 can swing about the center Od of drive pin 154 at a radius E2, as shown in FIG. 4. Such swing motion of center Oc is illustrated as arc Oc-'—Oc''' in FIG. 4. This swing motion allows the orbiting scroll 30 to compensate its motion for changes in Ro due to wear on the spiral elements 282, 302 or due to other dimensional inaccuracies of the spiral elements. When drive shaft 15 rotates, a drive force Fd is exerted at Od to the left and a reaction force Fr of gas compression appears at Oc to the right, with both forces being parallel to line L1. Therefore, the arm Od-Oc can swing outward by the creation of the moment generated by forces Fd and Fr so that, spiral element 302 of orbiting scroll 30 is forced toward spiral element 282 of fixed scroll 28 and orbiting scroll 30 orbits with the radius Ro around center Os of drive shaft 15. The rotation of orbiting scroll 30 is prevented by a rotation preventing mechanism, described more fully hereinafter, whereby orbiting scroll 30 orbits and keeps its relative angular relationship. The fluid pockets move because of the orbital motion of orbiting scroll 30, to thereby compress the fluid.

The use of the bushing 33 with eccentric hole 332 has the following advantages.

When fluid is compressed by orbital motion of orbiting scroll 30, reaction force Fr, caused by the compression of the fluid, acts on spiral element 302. This reaction force Fr acts in a direction tangential to the circle of orbiting motion. This reaction force, which is shown as Fr of FIG. 4, in the final analysis, acts on center Oc of bushing 33. Since bushing 33 is rotatably supported by drive pin 154, bushing 33 is subject to a rotating moment generated by Fd and Fr with radius E2 around center Od of drive pin 154. This moment is defined as Fd(E2)(sin $\theta$), where $\theta$ is the angle between the line Od-Oc and line L1, because Fd=Fr. Orbiting scroll 30 which is supported by bushing 33, is also subject to the rotating moment with radius E2 around center Od of drive pin 154 and, hence, the rotating moment is also transfered to spiral element 302. This moment urges spiral element 302 against spriral element 282 with an urging force Fp. Fp acts through a moment arm $E3=E2 \cos \theta$. Since the moments are equal, $FpE2 \cos \theta = FdE2 \sin \theta$. Thus, urging force $Fp=Fd \tan \theta$. When orbiting scroll 30 is driven through a bushing 33 having eccentric hole 332, the urging force which acts at the line contact between both spiral element 302 and 282 will be automatically derived from the reaction force whereby a seal of the fluid pockets is attained.

In addition, center Oc of bushing 33 is rotatable around center Od of drive pin 154. Therefore, if a pitch of a spiral element or a wall thickness of a spiral element, due to manufacturing inaccuracy or wear, has a dimentional error, distance Oc-Od can change to accomodate or compensate for the error. Orbiting scroll 30 thereby moves smoothly along the line contacts between the spiral elements. So that, if only the urging force Fp acts on the spiral element 302 of orbiting scroll 30 to press it against spiral 282, the center Oc swings as seen in FIG. 4, and a balance weight is not needed when the centrifugal force is not excessive. But, in a dynamic situation, $F_p$ is not the only force urging the spiral elements together. If bushing 33 is not provided with balance weight 331, a centrifugal force F1 caused by orbiting motion of orbiting scroll 30, bearing 34 and bushing 33 is added to the urging force $F_p$. Since the centrifugal force F1 is proportional to the orbiting speed of the orbiting parts, the contact force between the spiral elements 282, 302 would also increase as the drive shaft speed increases. Friction force between spiral element 302 and 282 would thereby be increased, and wearing of both spiral elements and also mechanical friction loss would increase. In a situation where the needle bearing 34 is omited, the centrifugal force F1 would arise from the orbiting of the scroll 30 and the bushing 33.

Therefore, to cancel centrifugal force F1, a balance weight 331 is connected to bushing 33 to generate a centrifugal force F2. The mass of the balance weight 331 is selected so that the centrifugal force F2 is equal in magnitude to the centrifugal force F1 and located so that the centrifugal forces F1 and F2 are opposite in direction. Wear of both spiral elements will thereby also be decreased; while the sealing force $F_p$ of fluid pockets, which is independent of shaft speed, will be secured by the contact between the spiral elements described in FIG. 4.

Figure 5:
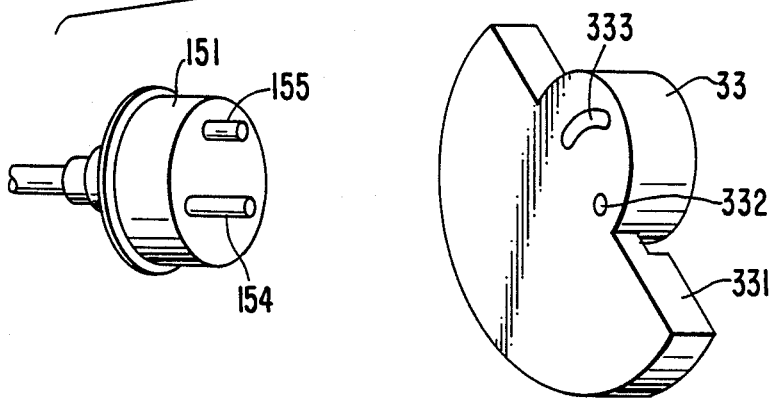
FIG. 5 is a perspective view of a modified driving mechanism.

It is advantageous that bushing 33 is freely rotatable on the drive pin 154, so that bushing 33 is movable vertically to accomodate for dimensional errors in the spiral elements. But if bushing 33 would be fully freely rotatable around drive pin 154, the balance weight would interfere with interior wall of the housing. Therefore, to limit the rotational movement of bushing 33 around drive pin 154, the unit is provided with a swing angle limiting mechanism which is shown in FIG. 5.

The swing angle limiting mechanism is formed as a projection, such as a pin 155, from either the bushing 33 or the disk 151, and a reception opening for the projection, such as an arc-shaped groove 333, in the other of the bushing 33 or disk 15. Disk 151 of drive shaft 15 is provided with the coupling pin 155 at its end surface and bushing 33 has the arc-shaped groove 333 formed on the end surface of the disk 151 for receiving the pin 155. Groove 333 extends in an arc with its center at the center of eccentric hole 332 and a radius of the distance between drive pin 154 and pin 155. The reception of the coupling pin 155 within the groove 333 limits the amount of swing of the bushing 33 to a selected degree.

As mentioned above, suitable sealing force of the fluid pocket is accomplished by using bushing 33 having balance weight 331. However, a centrifugal force F1 arises due to orbiting of scroll 30, bearing 34 and the portion of bushing 33 excluding balance weight 331; and centrifugal force F2 arises due to orbiting of balance weight 331. The centrifugal forces F1, F2 are made equal in magnitude, however, direction of the forces is opposed. Since the acting points of these centrifugal forces are spaced apart axially, a moment arises and vibration of the unit can occur.

Acting point of F1 is a centroid, i.e., center of mass, G30 of orbiting scroll 30, bearing 34 and bushing 33, and acting point of F2 is a centroid G331 of balance weight 331. Balance weight 331, which is attached to bushing 33 and thereby coupled to orbiting scroll 30, is axially offset from the scroll 30. Therefore, centroid G30 is not aligned with centroid G331 in an axial direction of the shaft 15. To prevent vibration caused by the moment created by this axial offset, the compressor unit is provided with a cancelling mechanism which is shown in FIG. 1. Drive shaft 15 is provided with a pair of balance weights 35, 36. Balance weight 35 is placed on the shaft 15 near or adjacent to balance weight 331 to cause a centrifugal force in the same direction as the centrifugal force of balance weight 331. Balance weight 36 is placed on shaft 15 on an opposite radial side of drive shaft 15 as balance weight 35 and on an opposite side in the axial direction relative to balance weight 331. Balance weight 36 causes centrifugal force in an opposite direction to the centrifugal force of balance weight 35.

Namely, as shown by FIG. 1, balance weight 35 is disposed in a counterbore 130 in the front end opening of cylindrical housing 11 and is fixed by a bolt 37 to a front end surface of disk 151. Balance weight 36 is fixed to or formed intergral with a stopper plate 38 which is supported by armature 21 of the magnetic clutch.

Figure 6:
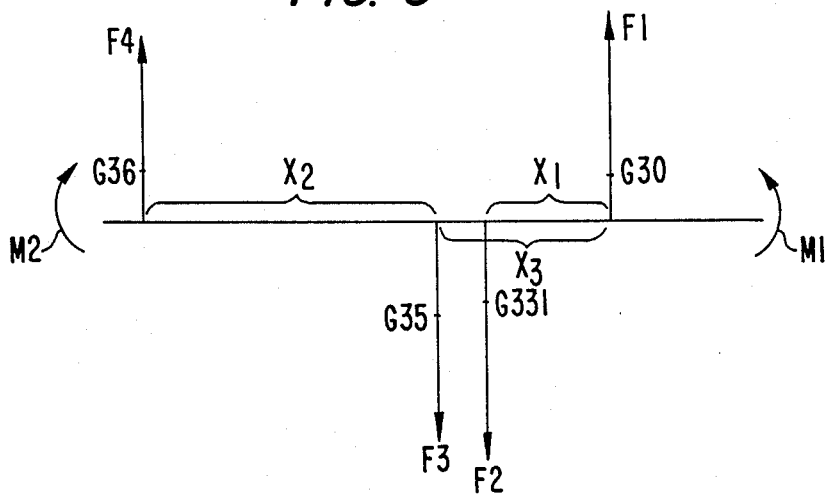
FIG. 6 is a diagram of the dynamic balance in the embodiment of FIG. 1.

Centrifugal force of balance weight 35 and 36 is designated as F3 and F4, respectively, and the relation of the centrifugal forces F1, F2, F3 and F4 is shown in FIG. 6. As mentioned above F1=F2 so that this moment, i.e., the moment created due to the axial offset of centroids G30 and G331, is defined by $F1(X_1)$, where $X_1$ is distance from centroid G30 of orbiting scroll 30, bearing 34 and bushing 33 to centroid 331 of balance weight 331 along the axis of shaft 15. The direction of the moment is shown by curved arrow M1 in FIG. 6 and is made up of the moments created by the forces F1 and F2. Another moment is created due to the centrifugal forces created by the rotation of axially spaced balance weights 35, 36. The mass of balance weight 35 and 36 is designed so that F3=F4. This moment is shown as $F3(X_2)$ and the direction of rotation by this moment is opposed to the moment $F1(X_1)$ where $X_2$ is a distance between centroid G35 and G36 along the axis of shaft 15. The direction of the second moment is shown by curved arrow M2 in FIG. 6. To prevent vibration of compressor unit 1 the distance $X_2$ and/or the unbalance amount (i.e., mass) of 35, 36 is selected so that $F1(X_1)=F3(X_2)$.

Another technique to attain better sealing between the two spiral surfaces is a modification of the aforementioned balancing technique with an acceptable amount of sacrifice of a very low mechanical loss of the machine. In this technique the centrifugal force F1 is made slightly smaller than F2 by an amount S. In order to attain a static balance F3 must be larger than F4 by the same amount S. Then dynamic unbalance of the amount $X_3S$ appears, however, an appropriate compromise between static and dynamic balance can still result in an acceptable level of vibration at a maximum shaft speed of the machine.

This technique may become necessary when the space for the eccentric bushing balance weight is limited so that complete cancellation of the centrifugal force F1 of the orbiting parts assembly cannot be attained. By sacrificing the perfect dynamic balance slightly, a better seal between the two spiral surfaces can be obtained which results in a higher volumetric efficiency. In turn, this generates a better performance coefficient, which is defined as the refrigerant capacity per unit horsepower in some operating range of the compressor, and also an optimum space arrangement is accomplished which results in a more compact compressor with less weight.

Figure 7:
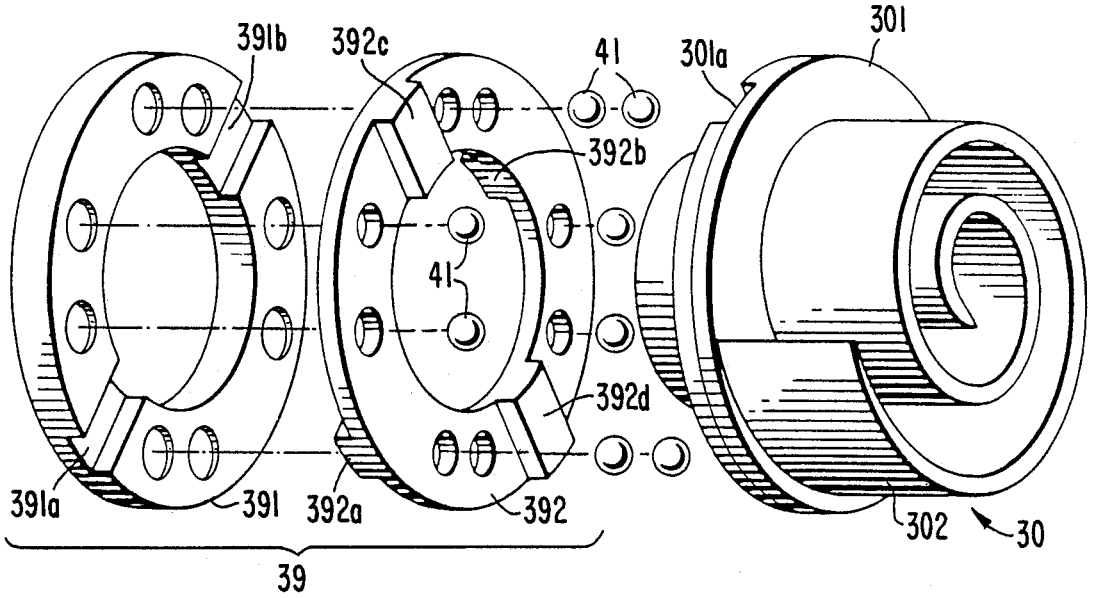
FIG. 7 is an exploded perspective view of a rotation preventing mechanism in the embodiment of FIG. 1.

Referring to FIG. 7 and FIG. 1, a rotation preventing mechanism 39 will be described. Rotation preventing mechanism 39 surrounds boss 303 and includes a fixed ring 391 and an Oldham ring 392. Ring 391 is secured to a stepped portion 112 of the inner surface of cylindrical housing 11 by pins 40. Fixed ring 391 has a pair of keyways **391*a* and 391*b* in an axial end surface facing orbiting scroll 30. Oldham ring 392 is disposed in a hollow space between fixed ring 391 and circular plate 301 of orbiting scroll 30. Oldham ring 392 has a pair of keys 392*a* and 392*b* on the surface facing fixed ring 391, which are received in keyways 391*a* and 391*b*. Therefore, Oldham ring 392 is slidable in the radial direction by the guide of keys 392*a* and 392*b* within keyways 391*a* and 391*b*. Oldham ring 392 also has a pair of keys 392*c* and 392*d* on its opposite surface. Keys 392*c* and 392*d* are arranged along a diameter perpendicular to the diameter along which keys 392*a* and 392*b* are arranged. Circular plate 301 of orbiting scroll member 30 has a pair of keyways, one of which is shown as 301*a* in FIG. 7, on a surface facing Oldham ring 392 in which are received keys 392*c* and 392*d*. The keyways of plate 301 are formed outside the diameter of boss 303. Therefore, orbiting scroll 30 is slidable in a radial direction by guide of keys 392*c* and 392*d* within the keyways of circular plate 301**.

Oldham ring 392 reciprocates along the direction of key **392*a*—*b* or keyway 391*a*–*b*, which creates vibration due to inertia. This cannot be cancelled by the aforementioned technology, however, by making Oldham ring 392** light, the vibration can be of an acceptable level.

Accordingly, orbiting scroll 30 is slidable in one radial direction with Oldham ring 392, and is slidable in another radial direction independently. The second sliding direction is perpendicular to the first radial direction. Therefore, orbiting scroll 30 is prevented from rotating, but is permitted to move in two radial directions perpendicular to one another.

In addition, bearing elements 41 are supported in openings of Oldham ring 392, and between fixed ring 391 and circular plate 301, and therefore function as a thrust bearings for orbiting scroll 30.

This invention has been described in detail in connection with the preferred embodiments, but these are examples only and this invention is not restricted thereto. It will be easily understood by those skilled in the art that the other variations and modifications can be easily made within the scope of this invention.

We claim:

1. Fluid apparatus of the positive displacement scroll type comprising:

a. a first wrap element defining at least an inner facing flank surface of generally spiroidal configuration about a first axis and extending between first and second axial tip portion;

b. a second wrap element defining at least an outer facing flank surface of generally spiroidal configuration about a second axis and extending between first and second axial tip portions, said first and second wrap elements being disposed in intermeshing, angularly offset relationship with their respective axes generally parallel;

c. end plate means in overlying, substantially sealing relationship to the first and second axial tip portions of said first and second wrap elements;

d. radially compliant means for effecting relative orbital motion between said first and second wrap elements such that actual moving line contact between the inner facing flank surface of said first wrap element and the outer facing flank surface of said second wrap element defines between said end plate means a moving volume which progresses from one of a radially outer and inner portion of said wrap elements to the other of said portions; said radially compliant means including:

i. crankshaft means including shaft means supported for rotation about a shaft axis parallel to said first and second axes and crank means affixed to said shaft means and radially offset therefrom;

ii. linkage means operatively interconnecting said crankshaft means and one of said first and second wrap elements such that rotation of said crankshaft means is accompanied by orbital motion of said one wrap element about said shaft axis and said one wrap element is free to undergo at least limited movement in a radial direction with respect to said shaft axis; said linkage means comprising a linkage member operatively connected to said crank means at a crank axis and to said one wrap element at a third axis substantially parallel to said crank and shaft axes such that a drive force acts along a first line extending between said crank axis and said third axis during orbital motion of said one wrap element, said first line making a predetermined angle with respect to a line drawn through said third axis tangent to the orbit path of said one wrap element such that the drive force has a component acting in a radially outward direction with respect to said shaft axis, whereby a sealing force is provided between the flank surfaces of said first and second wrap elements at their moving line contacts; and iii. counterweight means acting upon said one wrap element and rotatable with said crankshaft, said counterweight means having a mass so-positioned and of a magnitude as to impose a force upon said one wrap element in a radially inward direction with respect to said shaft axis which is substantially equal to the radially outward centrifugal force experienced by said one wrap element as it undergoes orbital motion, whereby the sealing force between said first and second wrap elements is substantially independent of the rotational speed of said crankshaft means; and e. fluid port means for admitting a working fluid to said moving volume adjacent said one of the radially outer and inner portions of said wrap elements, and for discharging same adjacent the other of said portions.

2. Fluid apparatus of the positive displacement scroll type comprising:

a. first wrap element defining at least an inner facing flank surface of generally spiroidal configuration about a first axis and extending between first and second axial tip portions;

b. a second wrap element defining at least an outer facing flank surface of generally spiroidal configuration about a second axis and extending between first and second axial tip portions, said first and second wrap elements being disposed in intermeshing, angularly offset relationship with their respective axes generally parallel;

c. end plate means in overlying substantially sealing relationship to the first and second axial tip portions of said first and second wrap elements;

d. radially compliant means for effecting relative orbital motion between said first and second wrap elements such that actual moving line contact between the inner facing flank surface of said first wrap element and the outer facing flank surface of said second wrap element defines between said end plate means a moving volume which progresses from one of a radially outer and inner portion of said wrap elements to the other of said portions; said radially compliant means including:

i. crankshaft means including shaft means supported for rotation about a shaft axis parallel to said first and second axes and crank means affixed to said shaft means and radially offset therefrom;

ii. linkage means operatively interconnecting said crankshaft means and one of said first and second wrap elements such that rotation of said crankshaft means is accompanied by orbital motion of said one wrap element about said shaft axis and said one wrap element is free to undergo at least limited movement in a radial direction with respect to said shaft axis; said linkage means comprising a linkage member operatively connected to said crank means at a crank axis and to said one wrap element at a third axis substantially parallel to said crank and shaft axes such that a drive force acts along a first line extending between said crank axis and said third axis during orbital motion of said one wrap element, said first line making a predetermined angle with respect to a line drawn through said third axis tangent to the orbital path of said one wrap element such that the drive force has a component acting in a radially outward direction with respect to said shaft axis, whereby a sealing force is provided between the flank surfaces of said first and second wrap elements at their moving line contacts; said one wrap element and end plate means including a bore disposed along said third axis and said linkage member further including a stub shaft comprising a cylindrical surface of said linkage member in engagement with said bore; and iii. counterweight means acting upon said one wrap element and rotatable with said crankshaft, said counterweight means having a mass so-positioned and of a magnitude as to impose a force upon said one wrap element in a radially inward direction with respect to said shaft axis which is substantially equal to the radially outward centrifugal force experienced by said one wrap element as it undergoes orbital motion, whereby the sealing force between said first and second wrap elements is substantially independent of the rotational speed of said crankshaft means; and e. fluid port means for admitting a working fluid to said moving volume adjacent said one of the radially outer and inner portions of said wrap elements, and for discharging same adjacent the other of said portions.

3. Fluid apparatus of the positive displacement scroll type comprising:

a. a first wrap element defining at least an inner facing flank surface of generally spiroidal configuration about a first axis and extending between first and second axial tip portions;

b. a second wrap element defining at least an outer facing flank surface of generally spiroidal configuration about a second axis and extending between first and second axial tip portions, said first and second wrap elements being disposed in intermeshing, angularly offset relationship with their respective axes generally parallel;

c. end plate means in overlying, substantially sealing relationship to the first and second axial tip portions of said first and second wrap elements;

d. radially compliant means for effecting relative orbital motion between said first and second wrap elements such that actual moving line contact between the inner facing flank surface of said first wrap element and the outer facing flank surface of said second wrap element defines between said end plate means a moving volume which progresses from one of a radially outer and inner portion of said wrap elements to the other of said portions; said radially compliant means including:

i. crankshaft means including shaft means supported for rotation about a shaft axis parallel to said first and second axes and crank means affixed to said shaft means and radially offset therefrom;

ii. linkage means operatively interconnecting said crankshaft means and one of said first and second wrap elements such that rotation of said crankshaft means is accompanied by orbital motion of said one wrap element about said shaft axis and said one wrap element is free to undergo at least limited movement in a radial direction with respect to said shaft axis; said linkage means comprising a linkage member operatively connected to said crank means at a crank axis and to said one wrap element at a third axis substantially parallel to said crank and shaft axes such that a drive force acts along a first line extending between said crank axis and said third axis during orbital motion of said one wrap element, said first line making a predetermined angle with respect to a line drawn through said third axis tangent to the orbit path of said one wrap element such that the drive force has a component acting in a radially outward direction with respect to said shaft axis, whereby a sealing force is provided between the flank surfaces of said first and second wrap elements at their moving line contacts; said one wrap element and end plate means including a bore disposed along said third axis and said linkage member further including a stub shaft comprising a cylindrical surface of said linkage member in engagement with said bore and wherein said crank axis lies inside said bore; and iii. counterweight means acting upon said one wrap element and rotatable with said crankshaft, said counterweight means having a mass so-positioned and of a magnitude as to impose a force upon said one wrap element in a radially inward direction with respect to said shaft axis which is substantially equal to the radially outward centrifugal force experienced by said one wrap element as it undergoes orbital motion, whereby the sealing force between said first and second wrap elements is substantially independent of the rotational speed of said crankshaft means; and e. fluid port means for admitting a working fluid to said moving volume adjacent said one of the radially outer and inner portions of said wrap elements, and for discharging same adjacent the other of said portions.

4. In a scroll-type fluid displacement apparatus including a housing having a fluid inlet port and a fluid outlet port, a fixed scroll fixedly disposed within said housing and having first end plate from which a first wrap extends, an orbiting scroll having second end plate from which a second wrap extends, said first and second wraps interfitting at an angular offset to make a plurality of line contacts to define at least one pair of sealed off fluid pockets, a drive shaft rotatably supported by said housing, a drive pin extending from an inner end of said drive shaft at a location eccentric to the axis of said drive shaft for connection to said orbiting scroll to drive said orbiting scroll in orbital motion, and rotation preventing means for preventing the rotation of said orbiting scroll during the orbital motion of said orbiting scroll, whereby said fluid pockets change volume due to the orbital motion of said orbiting scroll, the improvement comprising said second end plate of said orbiting scroll having a boss on a side opposite to a side from which said second wrap extends, a bushing rotatably supported in said boss, said bushing having an eccentric hole located eccentric to the center of said bushing, and means for connecting said drive shaft to said orbiting scroll and for applying radial contact force between said first and second wraps during the orbital motion of said orbiting scroll independent of the rotational speed of said drive shaft, said connecting and applying means including said drive pin being rotatably received in said eccentric hole, a center of said drive pin being located on an opposite side to a center of said drive shaft with regard to a straight line which passes through the center of said bushing and is perpendicular to a connecting line passing through the center of said shaft and the center of said bushing, said center of said drive pin also being beyond the connecting line which passes through the center of said shaft and the center of said bushing in the direction of rotation of said drive shaft, said bushing having a first balance weight for cancelling centrifugal force which arises by orbiting motion of said orbiting scroll and the parts of said apparatus orbiting with it.

5. The improvement as claimed in claim 4 wherein said bushing can swing about the center of said drive pin through an arc whereby the radius of orbiting motion can vary.

6. The improvement as claimed in claim 5 wherein said drive shaft and bushing have a swing angle limiting means for restricting the angle of swing of said bushing.

7. The improvement as claimed in claim 6 wherein said swing angle limiting means is comprised of a projection extending from one of said bushing and said inner end of said drive shaft and a reception opening formed in the other of said bushing and said inner end of said drive shaft for receiving said projection.

8. The improvement as claimed in claim 4 wherein the center of mass of said orbiting scroll and said orbiting parts is axially offset from the center of mass of said first balance weight.

9. The improvement as claimed in claim 4 or 8 wherein said drive shaft has a second balance weight for causing a centrifugal force which acts in the same direction as the centrifugal force of said first balance weight and has a third balance weight to cancel the moment created by the interaction of the centrifugal force of said orbiting scroll and orbiting parts and the centrifugal force of said first balance weight by a moment created by the interaction of the centrifugal force of said second and third balance weights.

10. The improvement as claimed in claim 9 wherein the centrifugal force of said third balance weight is in a direction opposite the centrifugal force of said second balance weight and of equal magnitude.

11. The improvement as claimed in claim 9 wherein said second balance weight is disposed adjacent an inner end portion of said drive shaft, said third balance weight is disposed adjacent an outer end portion of said drive shaft.

12. The improvement as claimed in claim 11 wherein said second balance weight is fixed to a front end surface of said disk.

13. The improvement as claimed in claim 9 wherein said third balance weight is fixed to a stopper plate which comprises a portion of a magnetic clutch for coupling said drive shaft to a power source.

14. The improvement as claimed in claim 12 wherein said third balance weight is fixed to a stopper plate which comprises a portion of a magnetic clutch for coupling said drive shaft to a power source.

15. The improvement as claimed in claim 13 wherein said third balance weight is formed integral with said stopper plate.

16. The improvement as claimed in claim 4 including needle bearing disposed in a hollow space between said boss and said bushing.

17. The improvement as claimed in claim 4 including a bearing disposed in a hollow space between said drive pin and said eccentric hole.

18. The improvement as claimed in claim 4 wherein said fluid displacement apparatus is a compressor whereby as said fluid pocket moves to the center of both wraps its volume reduces to compress the fluid therein.

19. A fluid displacement apparatus comprising:

a housing having a fluid inlet port, a fluid outlet port, and a sleeve;

a fixed scroll fixedly disposed within said housing and having a first end plate from which a first wrap extends;

an orbiting scroll movably disposed within said housing and having a second end plate from which a second wrap extends, and a boss extending from an opposite surface of said second end plate, said first and second wraps interfitting at an angular offset to make a plurality of line contacts to define at least one sealed off fluid pocket;

a drive shaft supported for rotary motion by said sleeve of said housing, said drive shaft having a disk at its inner end;

a bushing having a connecting portion with a generally cylindrical circumferential surface rotatably supported in said boss by a bearing and a balance weight extending radially from said connecting portion about a portion of said circumferential surface;

a drive pin extending from said disk toward said bushing at a location spaced from the axis of rotation of said drive shaft, said drive pin being rotatably received within an eccentric hole in said bushing, said eccentric hole being at a location spaced from the center of said bushing, and said bushing center being spaced from said drive shaft center at a distance equal to a radius of orbital motion of said orbiting scroll;

means for applying radial contact force between said first and second wraps during the orbital motion of said orbiting scroll independent of the rotational speed of said drive shaft, said force applying means including an arrangement of the centers of said drive pin, drive shaft and bushing, and said balance weight;

said arrangement of said centers including the center of said drive pin being located on an opposite side to the center of said drive shaft with regard to a straight line passing through the center of said bushing and perpendicular to a connecting line passing through the center of said shaft and the center of said bushing, said center of said drive pin also being located beyond said connecting line in the direction of rotation of said drive shaft;

said balance weight having a mass and disposition to create a centrifugal force substantially equal in magnitude and opposite in direction to the centrifugal force of said orbiting scroll and the parts of said apparatus which orbit with said orbiting scroll.

20. A fluid displacement apparatus as claimed in claim 19 including a second balance weight coupled to said drive shaft adjacent said disk and having its mass located to create a centrifugal force in a direction the same as the direction of the centrifugal force of said first balance weight, and a third balance weight coupled to said drive shaft adjacent its opposite end and having a mass located to create a centrifugal force equal in magnitude and opposite in direction to the centrifugal force of said second balance weight.

21. A fluid displacement apparatus as claimed in claim 20 wherein said second balance weight is attached to a surface of said disk opposite the surface from which said drive pin extends and said third balance weight being attached to a distal end of said drive shaft and disposed exterior to said sleeve.

22. A fluid displacement apparatus as claimed in claim 20 wherein said third balance weight is attached to a stopper plate which comprises a portion of a magnetic clutch for coupling said drive shaft to a power source.

23. A fluid displacement apparatus as claimed in claim 19 wherein said boss is formed integral with said second end plate of orbiting scroll , and said bearing is comprised of a needle bearing.

24. A fluid displacement apparatus in accordance with claim 19, 20 or 21 wherein the center of mass of said first balance weight is offset along the axis of said drive shaft from the center of mass of said orbiting scroll and said orbiting parts.

25. A fluid displacement apparatus in accordance with claim 23 wherein a moment in a first rotative direction is created by the axially offset centrifugal forces of the rotating first balance weight and orbiting scroll and orbiting parts, and a moment equal in magnitude and opposite in rotative direction is created by the axially offset centrifugal forces created by the rotating motion of second and third balance weights at locations spaced along the axis of said drive shaft.

26. A fluid displacement apparatus as claimed in claim 19 wherein said apparatus is comprised of a fluid compressor whereby as said fluid pocket moves to the center of both wraps its volume reduces to compress the fluid therein.

27. In a scroll-type fluid displacement apparatus including a housing having a fluid inlet port and a fluid outlet port, a fixed scroll fixedly disposed within said housing and having first end plate from which a first wrap extends, an orbiting scroll having second end plate from which a second wrap extends, said first and second wraps interfitting at an angular offset to make a plurality of line contacts to define at least one pair of sealed off fluid pockets, a drive shaft rotatably supported by said housing, a drive pin extending from an inner end of said drive shaft at a location eccentric to the axis of said drive shaft for connection to said orbiting scroll to drive said orbiting scroll in orbital motion, and rotation preventing means for preventing the rotation of said orbiting scroll during the orbital motion of said orbiting scroll, whereby said fluid pockets change volume due to the orbital motion of said orbiting scroll, the improvement comprising said second end plate of said orbiting scroll having a boss on a side opposite to a side from which said second wrap extends, a bushing rotatably supported in said boss, said bushing having an eccentric hole located eccentric of the center of said bushing, means for connecting said drive shaft to said orbiting scroll and for applying radial contact force between said first and second wraps during the orbital motion of said orbiting scroll substantially independent of the rotational speed of said drive shaft, said connecting and applying means including said drive pin being rotatably received in said eccentric hole, a center of said drive pin being located on an opposite side to a center of said drive shaft with regard to a straight line, which passes through the center of said bushing and is perpendicular to a connecting line passing through the center of said shaft and the center of said bushing, said center of said drive pin also being beyond the straight line which passes through the center of said shaft and the center of said bushing in the direction of rotation of said drive shaft, said bushing having a first balance weight which causes a centrifugal force which is slightly less than the centrifugal force which arises by orbiting motion of the orbiting scroll and the parts of the apparatus which orbit with the orbiting scroll, resulting in a small net centrifugal force which urges the orbiting scroll against the fixed scroll to improve the seal therebetween, said shaft having a second balance weight for causing a centrifugal force which acts in the same direction as the centrifugal force of said first balance weight and has a third balance weight, the centrifugal force caused by the second balance weight being slighly greater than the centrifugal force caused by the third balance weight, whereby the moment created by the centrifugal forces of the second and third balance weights almost completely cancels the moment created by the centrifugal force of the orbiting scroll and orbiting parts and the centrifugal force of said first balance weight.

* * * * *

UNITED STATES PATENT AND TRADEMARK OFFICE

CERTIFICATE OF CORRECTION

PATENT NO. : 4,824,346

DATED : April 25, 1989

INVENTOR(S) : Masaharu Hiraga and Kiyoshi Terauchi

It is certified that error appears in the above-identified patent and that said Letters Patent is hereby corrected as shown below:

ON THE TITLE PAGE:

Change the inventive entity from "Masaharu Hiraga; Kiyoshi Terauchi; Kiyosh Miyazawa and Seiichi Sakamoto" to —Masaharu Hiraga and Kiyoshi Terauchi—.

Signed and Sealed this

Twenty-ninth Day of August, 1989

*Attest:*

DONALD J. QUIGG

*Attesting Officer*

*Commissioner of Patents and Trademarks*